US006722917B2

(12) United States Patent
Huang

(10) Patent No.: US 6,722,917 B2
(45) Date of Patent: Apr. 20, 2004

(54) USB HUB

(76) Inventor: Yea Yen Huang, No. 12, Alley 70, Sec. 1, Chung Hua Road, Tocheng City, Taipei Hsien (TW)

( * ) Notice: Subject to any disclaimer, the term of this patent is extended or adjusted under 35 U.S.C. 154(b) by 0 days.

(21) Appl. No.: 10/197,850

(22) Filed: Jul. 19, 2002

(65) Prior Publication Data

US 2003/0148656 A1 Aug. 7, 2003

(51) Int. Cl.[7] ..... H01R 13/72
(52) U.S. Cl. ..... 439/501; 439/502
(58) Field of Search ..... 439/501, 502, 439/528, 623, 652, 654

(56) References Cited

U.S. PATENT DOCUMENTS 4,259,635 A * 3/1981 Triplett ..... 324/149
5,071,367 A * 12/1991 Luu ..... 439/501
5,507,667 A * 4/1996 Hahn et al. ..... 439/501
5,720,628 A * 2/1998 Usui et al. ..... 439/502
6,058,089 A * 5/2000 Youens et al. ..... 369/75.1
6,359,764 B1 * 3/2002 Chou ..... 361/93.1
2002/0106933 A1 * 8/2002 Lee ..... 439/501

* cited by examiner

*Primary Examiner*—Hien Vu
(74) *Attorney, Agent, or Firm*—Troxell Law Office PLLC

(57) ABSTRACT

A hub is closed having a USB cable for connecting to a host computer, a longitudinal wire groove in a back side of the housing thereof and a receiving open chamber in the housing at one end of the longitudinal wire groove for receiving the cable and USB connector of the USB cable, the USB connector of the USB cable having circular retaining projections for friction engagement with respective semicircular retaining notches in the receiving open chamber.

1 Claim, 2 Drawing Sheets

USB HUB

BACKGROUND OF THE INVENTION

1. Field of the Invention

The present invention relates to a USB hub and, more particularly, to such a USB hub, which has a longitudinally extended back wire groove and a receiving open chamber adapted for receiving the cable and USB connector of the USB cable thereof.

2. Description of the Related Art

A USB (Universal Serial Bus) hub is used in a network for connecting a set of computer peripheral apparatus to a host computer. Various USB hubs are known. There are known USB hubs with a USB cable and USB hubs without USB cable. A USB hub with a USB cable requires much storage or delivery space when not in use. A USB cable must be separately prepared when installing a USB hub without USB. When dismounted, the detached USB cable tends to be missed somewhere else. Further, there is also known another prior art USB hub, which has a box for receiving the USB cable when not in use. However, this structure of USB hub is bulky.

SUMAMRY OF THE INVENTION

The present invention has been accomplished to provide a hub, which eliminates the aforesaid drawbacks. It is therefore the main object of the present invention to provide a hub, which has receiving means for receiving the cable and USB connector of the USB cable thereof when not in use. According to the present invention, the hub comprises a housing holding a USB jack circuit assembly, and a USB cable extended from the USB jack circuit assembly out of the housing for connecting to a host computer. The housing comprises a longitudinal wire groove in the back side and a receiving open chamber at one end of the longitudinal wire groove for receiving the cable and USB connector of the USB cable. The USB connector is secured in position by means of friction resistance when inserted into the receiving open chamber of the housing.

DETAILED DESCRIPTION OF THE PREFERRED EMBODIMENT

Figure 1:
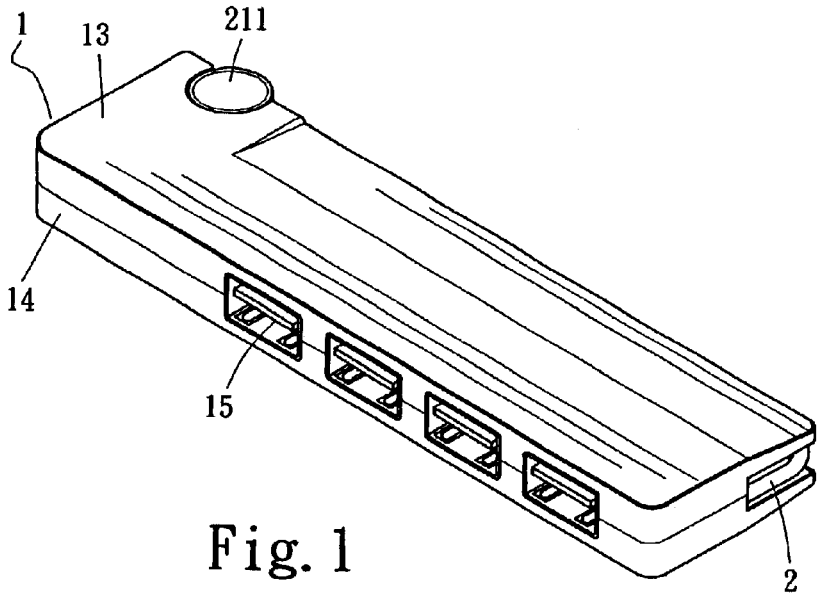
FIG. 1 is an elevational view of a USB hub according to the present invention.
Figure 2:
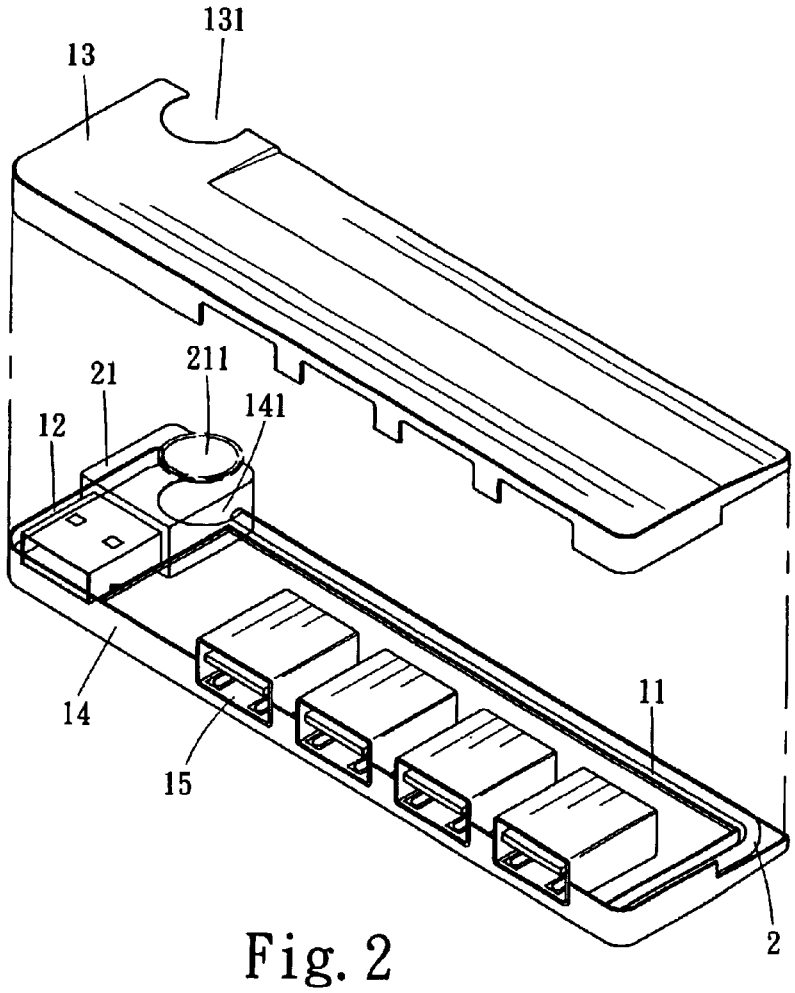
FIG. 2 is an exploded view of the USB hub according to the present invention.

Referring to FIGS. 1 and 2, a USB hub is shown comprised of a housing 1 formed of a top cover shell 13 and a bottom cover shell 14, a USB jack circuit assembly (formed of a circuit board and a number of USB jacks) 15 mounted in the housing 1, and a USB cable formed of a cable 2 and a USB connector 21. The cable 2 is extended from the USB jack circuit assembly 15. The USC connector 21 is provided at one end of the cable 2 remote from the USB jack circuit assembly 15, and adapted for connecting to a host computer (not shown). The housing 1 comprises a longitudinal wire groove 11 disposed in the back side, a receiving open chamber 12 disposed in one end of the longitudinal wire groove 1 and extended to the back side, and two semicircular retaining notches 131;141 respectively formed in the top cover shell 13 and the bottom cover shell 14 in communication with the receiving open chamber 12. The USB connector 21 comprises two circular retaining projections 211 respectively vertically protruded from the top and bottom sidewalls thereof. When not in use, the USB connector 21 is inserted into the receiving open chamber 12 to force the circular retaining projections 211 into friction-engagement with the semicircular retaining notches 131;141, keeping the cable 2 received in the longitudinal wire groove 11 of the housing 1.

Figure 3:
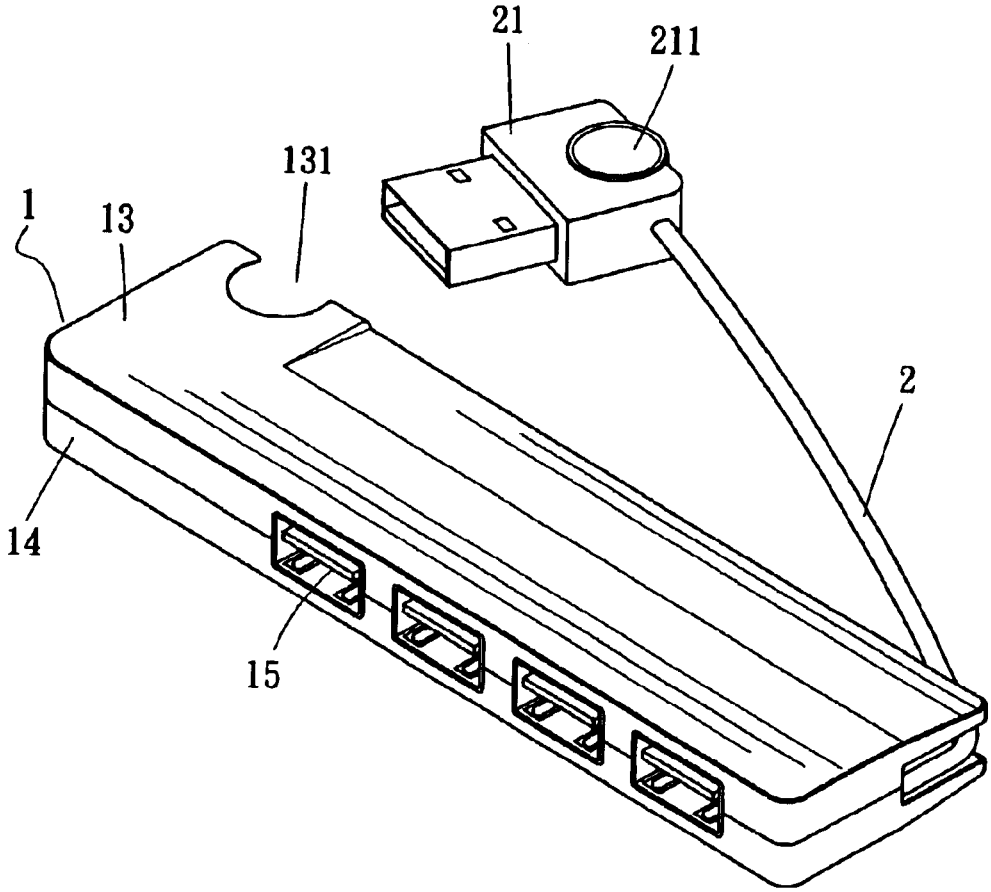
FIG. 3 is another elevational view of the present invention, showing the USB cable extended out of the housing of the USB hub.

Referring to FIG. 3 and FIG. 2 again, when not in use, pull the USB connector 21 outwards from the receiving open chamber 12 to disengage the circular retaining projections 211 from the semicircular retaining notches 131;141, and at the same time the cable 2 is moved with the USB connector 21 outwardly away from the longitudinal wire groove 1 of the housing 1.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A Universal Serial Bus (USB) hub comprising:

a housing;

a USB jack circuit assembly having a plurality of USB jacks mounted in said housing for receiving computer peripheral apparatus; and a USB cable having a cable electrically connected at a first end thereof to said USB jack circuit assembly for connecting said USB jacks to a host computer and connected at a second end thereof to a USB connector for connecting to a host computer, wherein said housing comprises a longitudinal wire groove disposed in a back side thereof adapted for receiving the cable of said USB cable, and a receiving open chamber at one end thereof disposed in communication with one end of said longitudinal wire groove and adapted for receiving the USB connector of said USB cable, wherein said housing further comprises two semicircular retaining notches disposed in top and bottom cover shells thereof in communication with said receiving open chamber at different elevations; said USB connector of said USB cable comprises two circular retaining projections respectively vertically protruding from a top and a bottom thereof and adapted for engaging said semicircular retaining notches by friction resistance to hold said USB connector of said USB cable in said receiving open chamber.

* * * * *